US007170253B2

(12) United States Patent
Spurr et al.

(10) Patent No.: US 7,170,253 B2
(45) Date of Patent: Jan. 30, 2007

(54) AUTOMOTIVE DOOR LATCH CONTROL BY MOTOR CURRENT MONITORING

(75) Inventors: Nigel V. Spurr, Shirley (GB); Michael J. Shelley, Fauldhouse (GB); Richard T. Hayes, Motherwell (GB); William F. Eaton, Pearl City, IL (US); Hugh D. Gibson, Edinburgh (GB); Alex Crawford, East Kilbride (GB); Ajaykumar Vaidhyanathan, Chennai, TN (US); Scott A. Vorwald, Lena, IL (US); Kenneth V. Bechtold, Freeport, IL (US); Curtis B. Johnson, Freeport, IL (US); Duncan S. Murchie, Crieff (GB); Daniel D. Kilker, University Park, FL (US); Abanni B. Maxwell, Rockford, IL (US); Patrick H. Shannon, Motherwell (GB); Gillian J. Madden, Bothwell (GB)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/940,345

(22) Filed: Sep. 14, 2004

(65) Prior Publication Data

US 2006/0022630 A1 Feb. 2, 2006

Related U.S. Application Data

(60) Provisional application No. 60/591,711, filed on Jul. 27, 2004.

(51) Int. Cl.
*G05F 1/10* (2006.01)

(52) U.S. Cl. ..... 318/650; 318/138; 318/254; 318/439; 318/286; 318/474; 318/453

(58) Field of Classification Search ..... 318/138, 318/254, 439, 453, 700, 286, 474, 560–650
See application file for complete search history.

(56) References Cited

U.S. PATENT DOCUMENTS

| | | | | |
|---|---|---|---|---|
| 4,328,540 | A * | 5/1982 | Matsuoka et al. | 700/56 |
| 4,338,553 | A * | 7/1982 | Scott, Jr. | 318/266 |
| 4,511,832 | A * | 4/1985 | Schmitz | 318/685 |
| 5,434,487 | A * | 7/1995 | Long et al. | 318/286 |
| 5,514,977 | A * | 5/1996 | Agiman | 324/772 |

(Continued)

*Primary Examiner*—Lincoln Donovan
*Assistant Examiner*—Tyrone Smith
(74) *Attorney, Agent, or Firm*—Kermit D. Lopez; Luis M. Ortiz

(57) ABSTRACT

Latch control methods and systems are disclosed, including a latch that receives power from a motor associated with a latch. A sensor can be provided for monitoring the current consumption of the motor. A microcontroller can control the latch and/or the motor, based on the current consumption data received from the sensor concerning the current consumption of the motor. Monitoring of the current waveform of the motor therefore provides speed and direction feedback data for control of the latch. Additionally, a microprocessor can process instructions for controlling the interaction of the motor, the latch, the sensor and/or the microcontroller. Such a current monitoring control system is made possible by variation in current consumption of the motor during rotation as a result of commutation, which can be interrogated by measuring the voltage drop across the motor or a shunt resistor, or through the use of other current sensors, such as, for example, a Hall-effect type current sensor.

10 Claims, 5 Drawing Sheets

U.S. PATENT DOCUMENTS 5,640,807 A * 6/1997 Shigematsu et al. ..... 49/449
5,765,884 A 6/1998 Armbruster ..... 292/216
5,975,596 A 11/1999 Rogers, Jr. et al. ..... 292/216
6,007,118 A 12/1999 Arabia, Jr. et al. ..... 292/216
6,037,727 A * 3/2000 Kawanobe et al. ..... 318/286
6,107,764 A * 8/2000 Blackburn ..... 318/254
6,111,378 A * 8/2000 LeMay et al. ..... 318/443
6,316,892 B1 * 11/2001 Valencia ..... 318/293
6,426,617 B1 * 7/2002 Haensgen et al. ..... 324/117 H
6,441,512 B1 8/2002 Jakel et al. ..... 307/10.2
6,474,706 B1 11/2002 Kalsi ..... 292/216
6,511,107 B2 1/2003 Barczynski et al. ..... 292/216
6,520,548 B1 2/2003 Fisher et al. ..... 292/201
6,568,722 B2 5/2003 Raffelsiefer et al. ..... 292/216
6,575,507 B2 6/2003 Reddmann ..... 292/216
6,601,883 B1 8/2003 Kalsi ..... 292/216
6,653,810 B2 * 11/2003 Lo ..... 318/569
6,719,356 B2 * 4/2004 Cleland et al. ..... 296/146.8
6,798,337 B2 * 9/2004 Onuma et al. ..... 340/5.72
6,847,179 B2 * 1/2005 Du et al. ..... 318/560
6,955,389 B2 * 10/2005 Suzuki et al. ..... 296/146.4
2002/0125994 A1 9/2002 Sandau ..... 340/5.62
2002/0180274 A1 12/2002 Suman ..... 307/10.2
2003/0043021 A1 3/2003 Chung ..... 340/5.71
2003/0182863 A1 10/2003 Mejean et al. ..... 49/26

* cited by examiner

AUTOMOTIVE DOOR LATCH CONTROL BY MOTOR CURRENT MONITORING

REFERENCE TO RELATED APPLICATION

This patent application claims priority under 35 U.S.C. § 119(e) to provisional patent application Ser. No. 60/591,711 entitled "Automotive Door Latch Control by Motor Current Monitoring," which was filed on Jul. 27, 2004, the disclosure of which is incorporated herein by reference.

TECHNICAL FIELD

Embodiments are generally related to door latch assemblies, including door latching mechanisms utilized in automobiles and other vehicles. Embodiments are also related to techniques for automatically controlling and monitoring vehicle door latches. Embodiments are additionally related to methods and systems for monitoring a motor to achieve automotive door latch functionality.

BACKGROUND OF THE INVENTION

Latching mechanisms (i.e., "latches") are utilized in a variety of commercial and industrial applications, such as automobiles, airplanes, trucks, and the like. For example, an automotive closure, such as a door for an automobile passenger compartment, is typically hinged to swing between open and closed positions and conventionally includes a door latch that is housed between inner and outer panels of the door. The door latch functions in a well-known manner to latch the door when it is closed and to lock the door in the closed position or to unlock and unlatch the door so that the door can be opened manually.

The door latch can be operated remotely from inside the passenger compartment by two distinct operators—a sill button or electric switch that controls the locking function and a handle that controls the latching function. The door latch is also operated remotely from the exterior of the automobile by a handle or push button that controls the latching function. A second distinct exterior operator, such as a key lock cylinder, may also be provided to control the locking function, particularly in the case of a front vehicle door. Each operator is accessible outside the door structure and extends into the door structure where it is operatively connected to the door latch mechanism by a cable actuator assembly or linkage system located inside the door structure.

Vehicles, such as passenger cars, are therefore commonly equipped with individual door latch assemblies which secure respective passenger and driver side doors to the vehicle. Each door latch assembly is typically provided with manual release mechanisms or lever for unlatching the door latch from the inside and outside of the vehicle, e.g. respective inner and outer door handles. In addition, many vehicles also include an electrically controlled actuator for remotely locking and unlocking the door latches.

Automotive latches are increasingly performing complex functions with fewer motors. For example, it is desirable to perform a variety of latch functions with only one motor. In such cases, increased accurate motor control systems and methods are required in order properly electrically actuate the latch and obtain the desired operation.

BRIEF SUMMARY OF THE INVENTION

The following summary of the invention is provided to facilitate an understanding of some of the innovative features unique to the present invention and is not intended to be a full description. A full appreciation of the various aspects of the invention can be gained by taking the entire specification, claims, drawings, and abstract as a whole.

It is, therefore, one aspect of the present invention to provide for an improved latch control and diagnostic mechanism.

It is another aspect of the present invention to provide for improved latching systems and methods for use in automobiles and other vehicles.

It is a further aspect of the present invention to provide methods and systems for monitoring a motor for achieving automotive door latch functionality.

It is yet another aspect of the present invention to provide methods and systems for the position control of a motor associated with an automotive door latch for achieving automotive door latch functionality thereof.

The aforementioned aspects of the invention and other objectives and advantages can now be achieved as described herein. Latch control methods and systems are disclosed, including a latch that receives power from a motor associated with a latch. A sensor can be provided for monitoring the current consumption of the motor. A microcontroller can control the latch and/or the motor, based on the current consumption data received from the sensor concerning the current consumption of the motor. Monitoring of the current waveform of the motor therefore provides speed and direction feedback data for control of the latch.

Additionally, a microprocessor can process instructions for controlling the interaction of the motor, the latch, the sensor and/or the microcontroller. Such a current monitoring control system is made possible by variation in current consumption of the motor during rotation as a result of commutation, which can be interrogated by measuring the voltage drop across the motor or a shunt resistor, or through the use of other current sensors, such as, for example, a Hall-effect type current sensor. Thus, the position control of a motor (e.g., a DC motor) for achieving door latch functionality can be achieved through the methods and systems described herein.

Embodiments can be implemented in the context of a latch control system generally composed of a latch, which receives power from a motor associated therewith, along with a sensor for monitoring the motor, wherein the sensor obtains current consumption data from the motor, which is associated with the motor. The microcontroller can therefore control the latch based on the current consumption data associated with the motor received from the sensor, by controlling an interaction of the motor with the latch. Additionally, the microprocessor can process instructions for controlling the interaction of the motor with the latch. The sensor can be implemented as a current sensor which ultimately provides speed and direction sensor for providing speed and direction data indicative of a speed and a direction of said latch based on said current consumption data associated with said motor.

Embodiments can also be implemented in the context of a program product residing in a memory of a data-processing system (e.g., a computer) for controlling a latch comprising generally instruction media residing in a memory of a data-processing system for providing a latch with power from the motor. Such an embodiment can also include instruction media residing in a memory of a data-processing system for monitoring the motor utilizing a sensor, wherein the sensor obtains current consumption data from the motor, which is associated with the motor. Such an embodiment additionally can include instruction media residing in a memory of a data-processing system for permitting a microcontroller to controls the latch based on the current consumption data associated with the motor received from the sensor, by controlling an interaction of the motor with the latch. Such instruction media can be implemented as signal bearing media, including, for example, recordable media and/or transmission media.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION OF THE INVENTION

The particular values and configurations discussed in these non-limiting examples can be varied and are cited merely to illustrate at least one embodiment of the present invention and are not intended to limit the scope of the invention.

Figure 1:
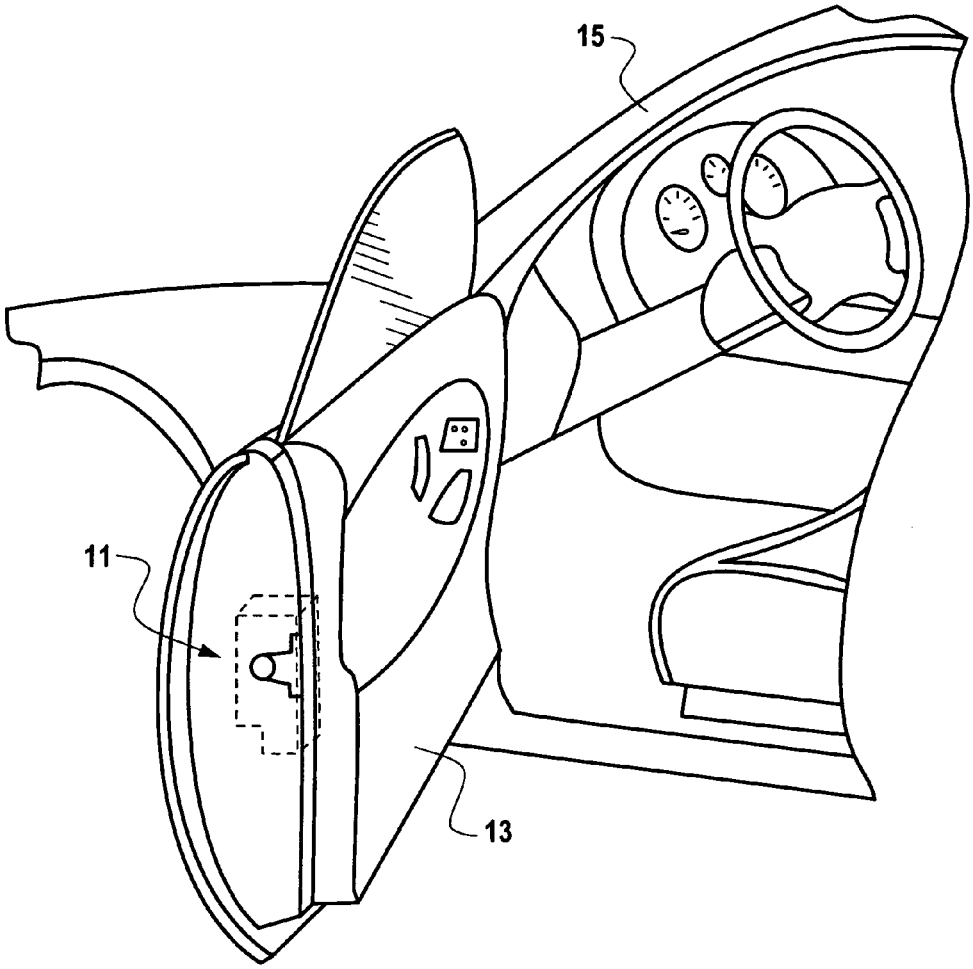
FIG. 1 illustrates a perspective view of a vehicle door mounted to a passenger vehicle in which a preferred embodiment of the present invention can be implemented.

FIG. 1 illustrates a perspective view of a vehicle door 13 mounted to a passenger vehicle in which a preferred embodiment of the present invention can be implemented. A vehicle, such as an automobile can be equipped with one or more individual door latch assemblies 11, which secure respective passenger and driver side doors to the vehicle 15. Each door latch assembly 11 can be provided with manual release mechanisms or lever for unlatching the door latch from the inside and outside of the vehicle, e.g. respective inner and outer door handles. In addition, many vehicles can also be equipped with electrically controlled actuators for remotely locking and unlocking the door latches. As indicated in FIG. 1, a door latch assembly 11 can be mounted to a driver's side vehicle door 13 of a passenger vehicle 15. The door latch assembly 11 may be mounted to front and rear passenger side doors thereof and may be incorporated into a sliding side door, rear door, a rear hatch or a lift gate thereof, depending upon design constraints.

Figure 2:
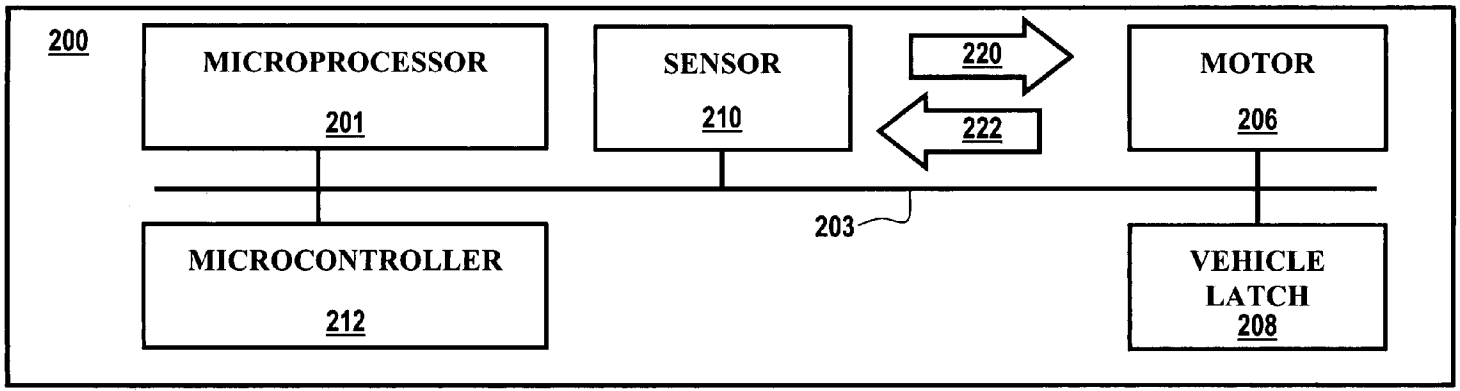
FIG. 2 illustrates a block diagram of a latch control system, which can be implemented in accordance with a preferred embodiment of the present invention.

FIG. 2 illustrates a block diagram of a latch control system 200, which can be implemented in accordance with a preferred embodiment of the present invention. System 200 can be implemented as a platform that allows for the control of motor 206 by monitoring, as indicated by arrows 220 and 222, the current waveform of motor 206 by a sensor 210, which provides speed and direction feedback to microcontroller 212 over a bus 203. Sensor 210 is connected to bus 203, along with a microprocessor 201, the microcontroller 212, and a vehicle latch 208. Motor 206 can be implemented as a vehicle motor within an automobile, or can be implemented as a micro-motor or compact motor, which operates solely in association with and for the operation of latch 208. Microprocessor 201 can be implemented as a processor whose elements have been miniaturized into one or more integrated circuit (IC) components. Microprocessor 201 generally is implemented in the context of a microchip containing integrated circuits that execute instructions.

Note that latch 208 of FIG. 2 is generally analogous to door latch assembly 11 of FIG. 1 and can be implemented within the context of an automobile, such as vehicle 15 of FIG. 1. The monitoring of the current waveform of motor 206 by sensor 210, as indicated by arrows 220 and 222 to provide speed and direction feedback information to system 200 for the control of motor 206 and ultimately for the control and operation of vehicle latch 208 permits sensor elements on driven components of vehicle latch 208 and/or motor 206 to be deleted. Such sensor elements on driven components are usually found on conventional vehicle latch systems, unlike system 200. The control configuration of system 200 is made possible by the variation in current consumption of motor 206 during rotation as a result of commutation.

Microprocessor 201 generally can be implemented as a central processing unit (CPU) via a single computer chip or a group of computer chips which function together to form a microprocessor unit. Microprocessor 201 therefore functions as the computational and control unit of system 200, and interprets and executes instructions provided to it via bus 203. Microprocessor 201 can fetch, decode, and execute instructions and transfer information to and from other resources of system 200 over bus 203. Microcontroller 212 can receive instructions and data over bus 203 and generally performs an arbitrating or regulating function for system 200.

Figure 3:
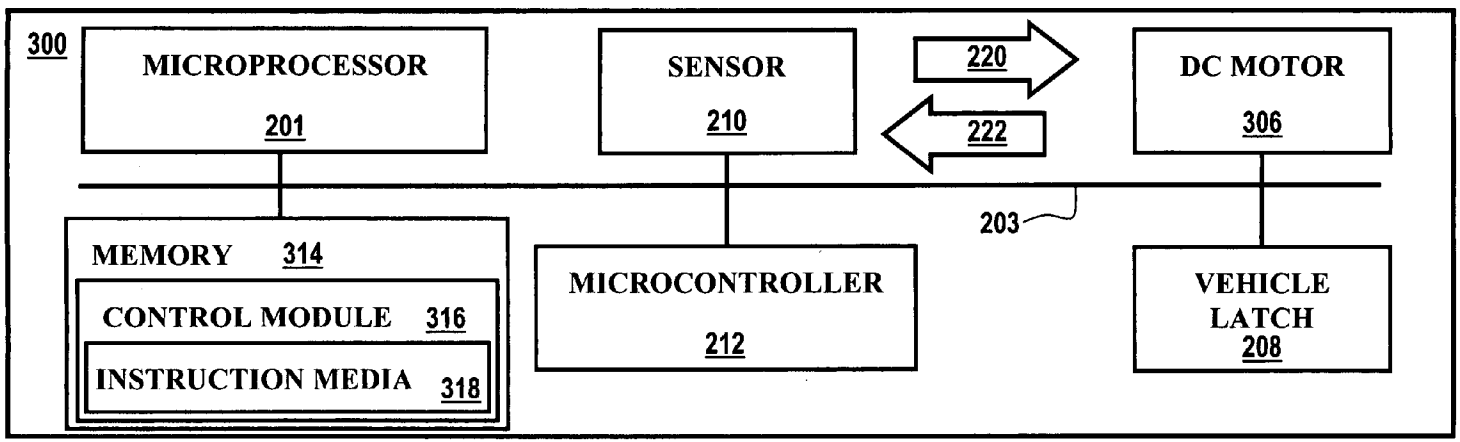
FIG. 3 illustrates a block diagram of a latch control system, which can be implemented in accordance with an alternative embodiment of the present invention.

FIG. 3 illustrates a block diagram of a latch control system 300, which can be implemented in accordance with an alternative embodiment of the present invention. Note that in FIGS. 2–6 herein, identical or similar parts or elements are generally indicated by identical reference numerals. Thus, system 300 generally includes all of the components of FIG. 2, in addition to a memory 314 that is composed of a control module 316 and instruction media 318. System 300 can be implemented as a data-processing system for controlling vehicle door latch 208 based on the position control of DC motor 306. Microcontroller 212 can control access to memory 314 and act as a control unit for memory 314 in addition to controlling a DC motor 306 based on data received from sensor 210 via bus 203. Note that DC motor 306 is connected to bus 208 and is generally associated with vehicle latch 208. Motor 306 can be implemented as a vehicle motor within an automobile, or can be implemented as a micro-motor or compact motor, which operates solely in association with and for the operation of latch 208.

Memory 314 can therefore be connected to bus 203, and includes control module 316 that resides within memory 314 and contains instructions that when executed on microprocessor 201, can carry out logical operations and instructions. Control module 316 can, for example, contain instructions such as those depicted in the flow diagram 700 of FIG. 7 herein. Control module 316 can therefore implement a computer program product. It is important that, while the embodiments have been (and will continue to be) described in the context of a data-processing system such as system 200, 300, 400 and 600, embodiments are capable of being distributed as a program product in a variety of forms, and that such embodiments can apply, equally regardless of the particular type of signal-bearing media utilized to actually carry out the distribution.

Examples of signal-bearing media include: recordable-type media, such as floppy disks, hard disk drives and CD ROMs, and transmission-type media such as digital and analog communication links. Examples of transmission-type media include devices such as modems. A modem is a type of communications device that enables a computer to transmit information over a standard telephone line. Because a computer is digital (i.e., works with discrete electrical signals representative of binary 1 and binary 0) and a telephone line is analog (i.e., carries a signal that can have any of a large number of variations), modems can be utilized to convert digital to analog and vice-versa. The term "media" as utilized herein is a collective word for the physical material such as paper, disk, CD-ROM, tape and so forth, utilized for storing computer-based information.

Control module 316 can therefore be implemented as a "module" or a group of "modules". In the computer programming arts, a "module" can be typically implemented as a collection of routines and data structures that performs particular tasks or implements a particular abstract data type. Modules generally are composed of two parts. First, a software module may list the constants, data types, variable, routines and the like that that can be accessed by other modules or routines. Second, a software module can be configured as an implementation, which can be private (i.e., accessible perhaps only to the module), and that contains the source code that actually implements the routines or subroutines upon which the module is based.

Thus, for example, the term module, as utilized herein generally refers to software modules or implementations thereof. Such modules can be utilized separately or together to form a program product that can be implemented through signal-bearing media, including transmission media and recordable media. A module can be composed of instruction media 318 which perform particular instructions or user commands, such as, for example controlling the interaction of vehicle latch 208, DC motor 306, sensor 210, microcontroller 212 and so forth. Control module 316 can be implemented, for example, as a Proportional Integral Derivative (PID) control algorithm, which can be utilized for the control of feedback loops.

Figure 4:
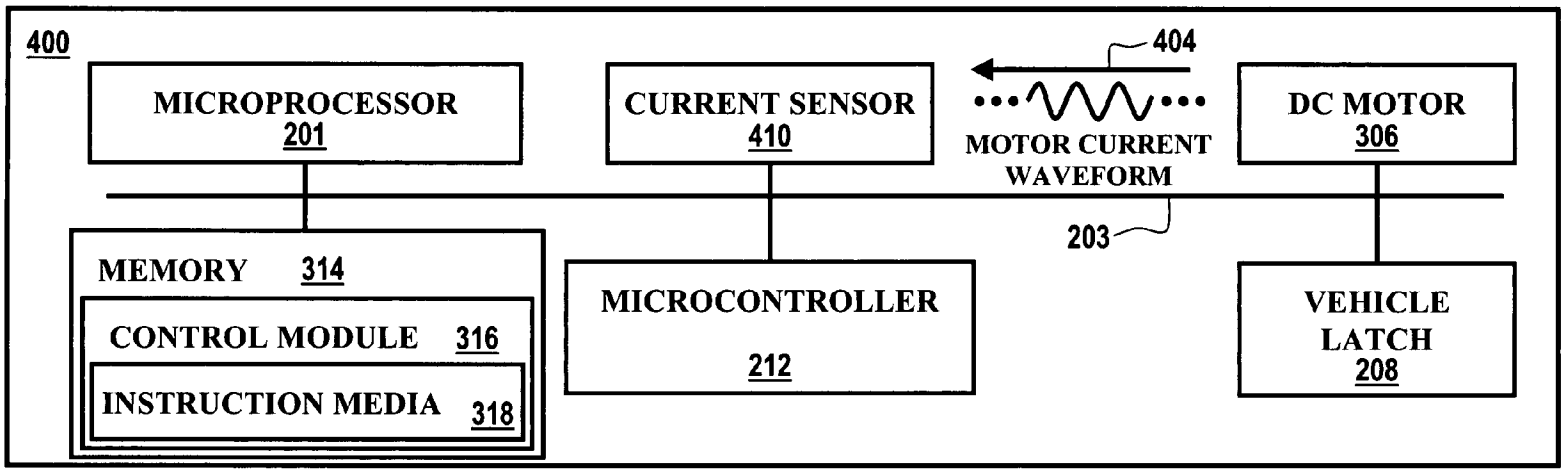
FIG. 4 illustrates a block diagram of a latch control system, which can be implemented in accordance with an alternative embodiment of the present invention.

FIG. 4 illustrates a block diagram of a latch control system 400, which can be implemented in accordance with an alternative embodiment of the present invention. Recall that in FIGS. 2–6 herein, identical or similar parts are generally indicated by identical reference numerals. Thus, system 400 of FIG. 4 is similar to system 300 of FIG. 3, the difference being that a specific current sensor 410 is utilized to monitor the motor current wave form of DC motor 306 as indicated by arrow 404. In this regard, however, it is important to note that sensor 210 of FIGS. 2–3 can be implemented as current sensor 410 for the same purpose, depending upon design considerations.

Figure 5:
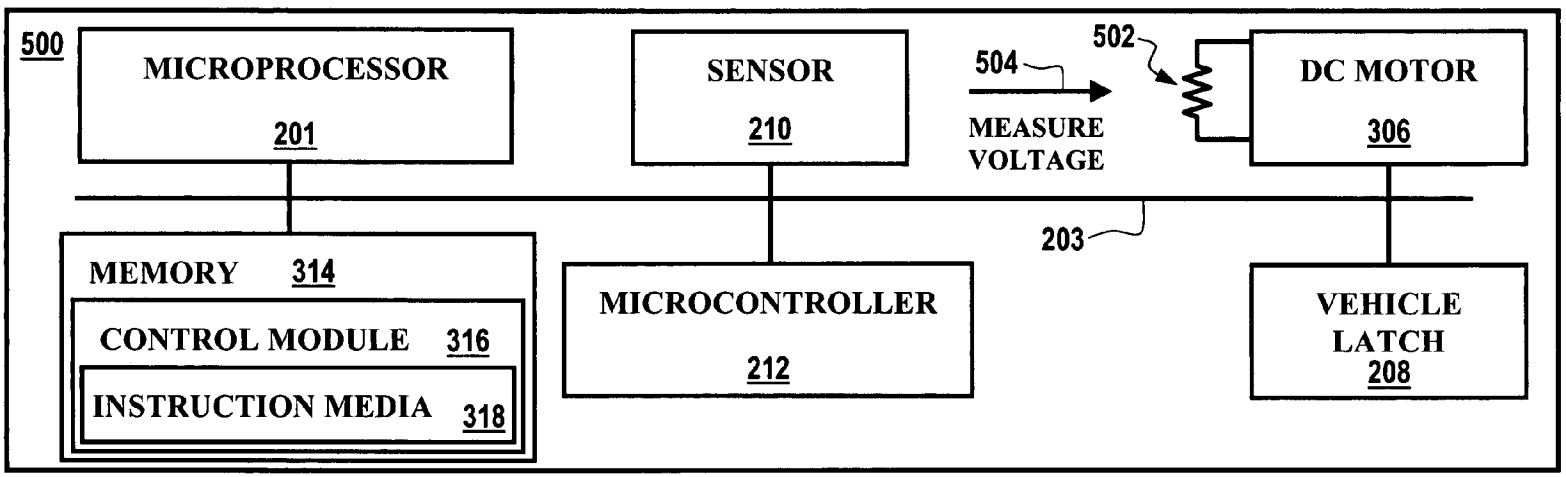
FIG. 5 illustrates a block diagram of a latch control system, which can be implemented in accordance with an alternative embodiment of the present invention.
Figure 6:
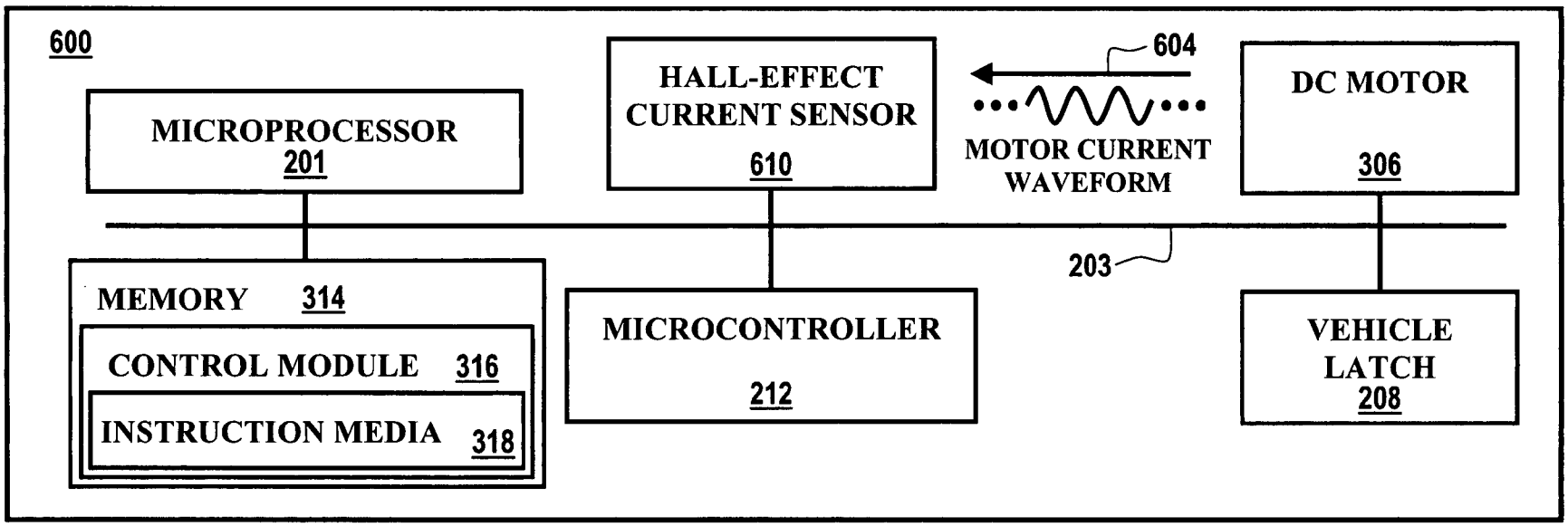
FIG. 6 illustrates a block diagram of a latch control system, which can be implemented in accordance with an alternative embodiment of the present invention.

FIG. 5 illustrates a block diagram of a latch control system 500, which can be implemented in accordance with a preferred embodiment of the present invention. In FIGS. 2–6 herein, identical or similar parts are generally indicated by identical reference numerals. Thus, system 500 of FIG. 5 is similar to system 400 of FIG. 4, the difference being that sensor 210 can be adapted for use not only as a current sensor, but as a sensor for measuring the voltage across a shunt resistor 502 associated with DC motor 306. The variation in current consumption of motor 306 during rotation as a result of commutation can be interrogated by measuring voltage drop across motor 306 or across shunt resistor 502. The variation in current consumption of motor 306 can also be measured utilized another type of current sensor such as a Hall-effect current sensor, which is depicted in FIG. 6.

FIG. 6 illustrates a block diagram of a latch control system 600, which can be implemented in accordance with an alternative embodiment of the present invention. Again, In FIGS. 2–6 herein, identical or similar parts are generally indicated by identical reference numerals. Thus, system 600 of FIG. 5 is similar to that depicted in systems 200, 300, 400 and 500, the difference being that system 600 utilizes a Hall-effect current sensor 610, which is connected to system 203 and monitors, as indicated by arrow 604, the current waveform of motor 306 to provide speed and direction feedback to system, including microcontroller 212, microprocessor 201 and/or memory 314 for the control of DC motor 306 and ultimately, the functioning of vehicle latch 208.

In general, a Hall-effect current sensor 610 can incorporate the use of one or more Hall-effect elements that rely on the reaction between a current flowing between a first set of contacts and an orthogonally-applied magnetic field to generate a voltage across a second set of contacts. A non-limiting example of a Hall-effect element is disclosed in U.S. Pat. No. 6,492,697, entitled "Hall-effect Element with Integrated Offset Control and Method for Operating Hall-effect Element to Reduce Null Offset," which issued to Plagens, et al. on Dec. 10, 2002 and is assigned to Honeywell International, Inc. of Morristown, N.J., U.S. Pat. No. 6,492,697 is incorporated herein by reference. A non-limiting example of a non-limiting Hall-effect sensor is disclosed in U.S. Pat. No. 6,225,716, entitled "Commutator Assembly Apparatus for Hall Sensor Devices," which issued to Sies, et al. on May 1, 2001, and is assigned to Honeywell International, Inc. of Morristown, N.J., U.S. Pat. No. 6,225,716 is incorporated herein by reference. Note that U.S. Pat. Nos. 6,492,697 and 6,225,716 are discussed for general illustrative and edification purposes only and are not considered to limit the embodiments disclosed herein.

Figure 7:
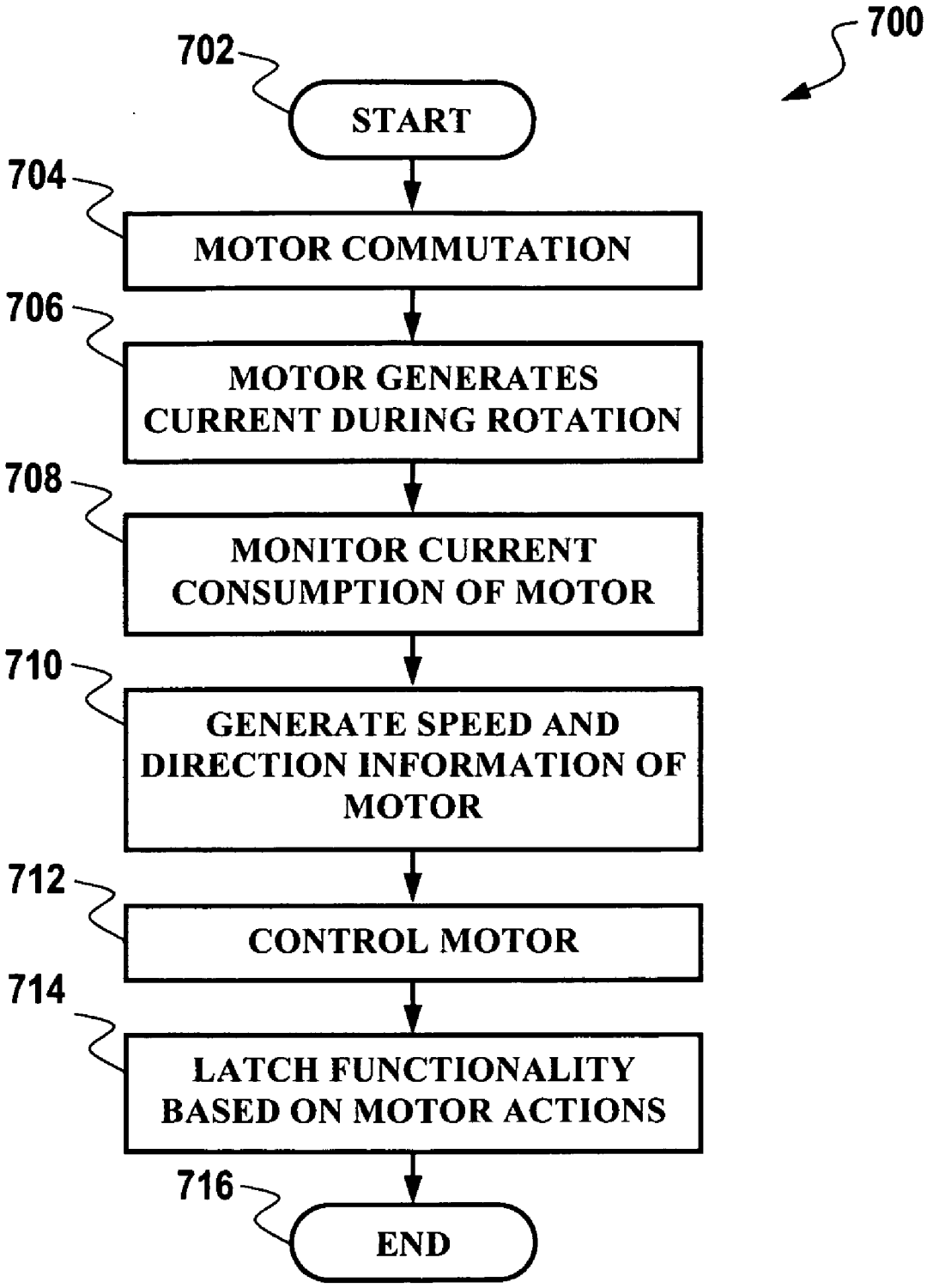
FIG. 7 illustrates a high-level flow chart depicting logical operational steps, which may be implemented in accordance with an alternative embodiment of the present invention.

FIG. 7 illustrates a high-level flow chart 700 depicting logical operational steps, which may be implemented in accordance with an alternative embodiment of the present invention. As indicated at block 702, the process can be initiated. A motor experiences commutation, as indicated at block 704. Examples of such a motor include motors 206 and 306. The motor generates a current during rotation as a result of commutation, as indicated at block 706. The current consumption of the motor can then be monitored utilizing a sensor, such as, for example, sensors 210 or 610. Thereafter, the speed and direction of the motor can be calculated, as indicated at block 710, based on the monitoring of the current waveform of the motor. Such speed and direction information and/or feedback data can be utilized to control the motor, as indicated at block 712 for achieving automotive latch functionality as, indicated at block 714 for a latch, such as, for example vehicle latch 208 described herein. The process can then terminate, as indicated at block 716.

The embodiments and examples set forth herein are presented to best explain the present invention and its practical application and to thereby enable those skilled in the art to make and utilize the invention. Those skilled in the art, however, will recognize that the foregoing description and examples have been presented for the purpose of illustration and example only. Other variations and modifications of the present invention will be apparent to those of skill in the art, and it is the intent of the appended claims that such variations and modifications be covered.

The description as set forth is not intended to be exhaustive or to limit the scope of the invention. Many modifications and variations are possible in light of the above teaching without departing from the scope of the following claims. It is contemplated that the use of the present invention can involve components having different characteristics. It is intended that the scope of the present invention be defined by the claims appended hereto, giving full cognizance to equivalents in all respects.

The embodiments of the invention in which an exclusive property or right is claimed are defined as follows.

Having thus described the invention what is claimed is:

1. A latch control system, comprising:

a latch associated with a motor for driving said latch, wherein said motor comprises a Direct Current (DC) motor that generates a current during a rotation of said DC motor;

a Hall-effect current sensor for monitoring a consumption of said current of said DC motor and generating speed and direction information of said motor, wherein said Hall-effect current sensor monitors a current waveform associated with said current;

a controller, which controls said DC motor and communicates with said latch, wherein said DC motor controls said motor based on said current waveform monitored by said Hall-effect current sensor, wherein said current waveform is derived from a measurement of a voltage drop across said DC motor, and wherein said Hall-effect current sensor provides data to said controller, which is indicative said current waveform associated with said DC motor in order to provide a position control of said DC motor based on said current waveform and achieve a latch functionality thereof based on a motor action of said DC motor;

a microprocessor, which communicates with said Hall-effect current, said sensor and said DC motor and which processes data provided by said Hall-effect current sensor, wherein said data is indicative of said current waveform associated with said DC motor;

a memory that communicates with said microprocessor; and a control module stored within said memory, wherein said control module is executable and retrievable by said microprocessor in order to control an interaction of said DC motor, said Hall-effect current sensor, and said microprocessor.

2. The system of claim 1 wherein said current waveform is derived by measuring said voltage drop across a shunt resistor associated with said DC motor.

3. The system of claim 2 wherein said Hall-effect current sensor comprises at least one Hall-effect element that relies on a reaction between a current flowing between a first set of contacts and an orthogonally-applied magnetic field to generate a voltage across a second set of contacts.

4. A latch control system, comprising:

a Direct Current (DC) motor;

a latch associated with said DC motor, wherein DC motor drives said latch; and a Hall-effect current sensor for monitoring a current consumption of said DC motor, wherein said Hall-effect current sensor comprises at least one Hall-effect element that relies on a reaction between a current flowing between a first set of contacts and an orthogonally-applied magnetic field to generate a voltage across a second set of contacts;

a controller, which controls said motor and communicates with said latch, wherein said motor controls said motor-based on a current waveform monitored by said Hall-effect current sensor, wherein said current waveform is derived by measuring a voltage drop across said motor; and a microprocessor, which communicates with said Hall-effect current sensor and said motor and which processes data provided by said Hall-effect current sensor, wherein said data is indicative of said current waveform associated with said motor a memory that communicates with said microprocessor; and a control module stored within said memory, wherein said control module is executable and retrievable by said microprocessor in order to control an interaction of said DC motor, said Hall-effect current sensor, and said microprocessor, wherein said Hall-effect current sensor monitors a current waveform in order to provide position control of said DC motor based on said current waveform and achieve a latch functionality thereof and wherein a variation in a current consumption of said DC motor during a rotation as a result of a commutation of said DC motor is interrogatable by measuring said voltage drop across said motor.

5. The system of claim 4 wherein:

said current waveform is derived by measuring said voltage drop across a shunt resistor associated with said DC motor; and wherein said control module comprises a Proportional Integral Derivative (PID) control algorithm.

6. A latch control method, comprising the steps of:

associating a latch with a motor for driving said latch, wherein said motor comprises a Direct Current (DC) motor;

measuring a current waveform utilizing a Hall-effect current sensor by measuring a voltage drop across said DC motor, wherein said Hall-effect sensor monitors a consumption of current of said DC motor and generates speed and direction information associated with said DC motor; and monitoring said DC motor with said Hall-effect current sensor, wherein said Hall-effect current sensor monitors said current waveform in order to provide position control of said DC motor based on said current waveform and achieve a latch functionality thereof based on a motor action of said DC motor;

providing a controller, which controls said motor and communicates with said latch, wherein said motor controls said motor based on said current waveform monitored by said Hall-effect current sensor;

providing a microprocessor, which communicates with said Hall-effect current sensor and said motor and which processes data provided by said hall-effect current sensor, wherein said data is indicative of said current waveform associated with said motor;

providing a memory that communicates with said microprocessor; and storing a control module within said memory, wherein said control module is executable and retrievable by said microprocessor in order to control an interaction of said DC motor, said Hall-effect current sensor, and said microprocessor.

7. The method of claim 6 further comprising the step of deriving said current waveform associated with said motor by measuring said voltage drop across a shunt resistor associated with said motor.

8. The method of claim 6 further comprising the steps of:

deriving said current waveform by measuring said voltage drop across a shunt resistor associated with said DC motor; and configuring said control module to comprise a Proportional Integral Derivative (PID) control algorithm.

9. The method of claim 6 further comprising configuring said Hall-effect current sensor to comprise at least one Hall-effect element that relies on a reaction between a current flowing between a first set of contacts and an orthogonally-applied magnetic field to generate a voltage across a second set of contacts.

10. The method of claim 6 further comprising the steps of:

configuring said Hall-effect current sensor to comprise at least one Hall-effect element that relies on a reaction between a current flowing between a first set of contacts and an orthogonally-applied magnetic field to generate a voltage across a second set of contacts;

deriving said current waveform by measuring said voltage drop across a shunt resistor associated with said DC motor; and configuring said control module to comprise a Proportional Integral Derivative (PID) control algorithm.

* * * * *